US005308064A

United States Patent [19]

Jen

[11] Patent Number: 5,308,064

[45] Date of Patent: May 3, 1994

[54] CROQUET STICK

[76] Inventor: Lin C. Jen, No. 82, Trong Wu Road, Trong We Hson, I-Lan, Taiwan

[21] Appl. No.: 82,204

[22] Filed: Jun. 24, 1993

[51] Int. Cl.[5] ..... A63B 59/10

[52] U.S. Cl. ..... 273/83; 273/167 C

[58] Field of Search ..... 273/83, 56, 67 A, 167 C, 273/67 C

[56] References Cited

U.S. PATENT DOCUMENTS 159,193 1/1875 Logan ..... 273/83

4,361,325 11/1982 Jansen ..... 273/67 A

*Primary Examiner*—Vincent Millin

*Assistant Examiner*—William M. Pierce

*Attorney, Agent, or Firm*—Pro-Techtor International

[57] ABSTRACT

An impoved croquet stick comprised of a stick with an opening, two half-pieces of stick head and opening, two half-pieces of stick haed and two connecting cases. Said stick head is comprised of the left and right half-pieces of stick head whose section is in semicircle shape. Two polygonal openings are located in the middle of the stick head wherein a protuberant pillaret is inserted into the opening of the hexagonal stick so as to connect the stick with the stick head together. There are corresponding arc slots on the surface of the stick head. Two connecting cases are secured on both sides of the stick head.

2 Claims, 5 Drawing Sheets

CROQUET STICK

BACKGROUND OF THE INVENTION

The present invention relates to an improved croquet stick comprised of a stick with an opening, two half-pieces of stick head and connecting cases secured on both sides of the stick head. The improved croquet stick of the present invention, which is easy to manufacture, can be mass-produced so as to reduce the cost of production. The improvement of croquet stick of the present invention is very practical.

Nowadays, croquet is one of the popular sports in Europe and the United States. The lover of croquet is increased rapidly.

The equipment of croquet is no other than the croquet stick and ball. The prior art croquet stick 60 is comprised of a stick 70 and a stick head 80. Both are made of wood. The wood is cut to cylinders in different sizes and diameters so that it is difficult to mass-produce and manufacture the prior art croquet stick. Meantime, the material of wood would hike up the cost of production. Therefore, a practical croquet stick is really in need.

The present invention provides an improved croquet stick comprised of a stick with an opening, right and left half-pieces of stick head and connecting cases secured on both sides of the stick head. Inside the right-half piece of stick head, there is a protuberant pillar. An hexagonal opening is in the middle of the complete stick head, which is composed of left and right half-pieces of stick head for connecting with the hexagonal stick. The protuberant pillar is inserted into the opening of stick. The two half-pieces are combined into one complete stick head with connecting cases secured on both sides. The advanced and practical design of the present invention, which is easy to manufacture and cost-efficient, can be mass-produced.

SUMMARY OF THE INVENTION

The present invention relates to an impoved croquet stick structure which is comprised of a stick with an opening, two half-pieces of stick haed and two connecting cases. The stick head is comprised of the left and right half-pieces of stick head. The section of left half-piece of stick head is in semicircle shape. A polygonal opening is located in the center-right of the left half-piece. The section of right half-piece of stick head is in semicircle shape, too. A polygonal opening is located in the center-left of the right halfpiece. Both pieces are combined together to be a hollow stick head. A protuberant pillaret is inserted into the opening of the hexagonal stick so as to connect the stick with the stick head together. There are corresponding arc slots on the surfaces of both half-pieces. Two connecting cases are secured on both sides of stick head.

DETAILED DESCRIPTION OF THE PREFERRED EMBODIMENTS

Figure 1:
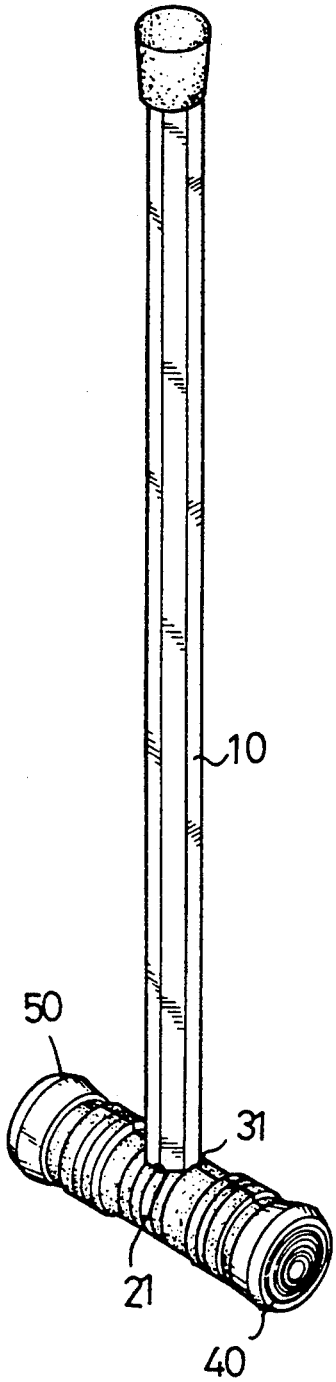
FIG. 1 is a three-dimensional external view of an improved croquet stick of the present invention.
Figure 2:
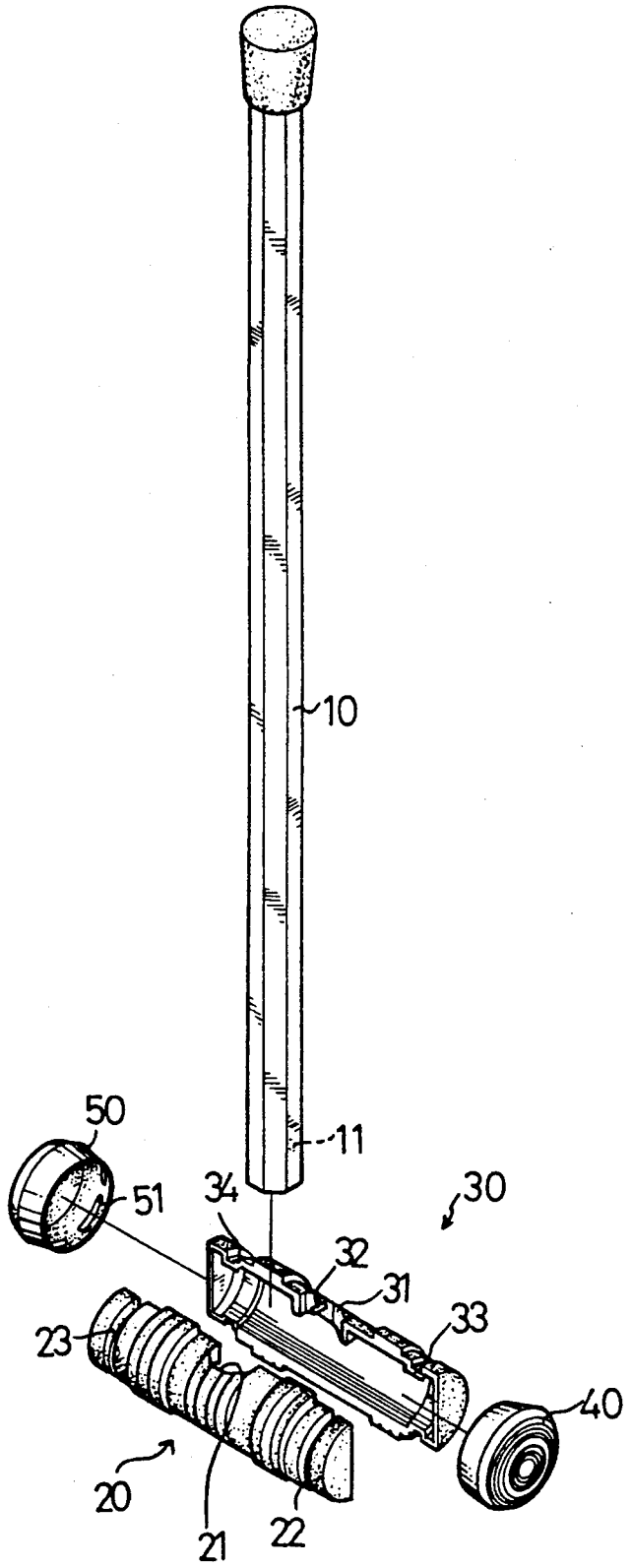
FIG. 2 is a three-dimentional exploded view of an improved croquet stick of the present invention.

Referring to FIGS. 1 and 2, therein illustrated is an improved structure of croquet stick of the present invention. The improved croquet stick is comprised of a stick 10, two half-pieces of stick head and connecting cases 40, 50. The stick 10 is a hexagonal pillar with an opening 11 in one side near the bottom. The stick head is comprised of a left half-piece 20 and a right half-piece 30 of stick head. The section of left half-piece 20 is in semicircle shape. A polygonal opening 21 is located in the center-right of the left half-piece. There are arc gutters 22,23 on the surface in the front and rear of left half-piece. The section of right-piece 30 is in semicircle shape, too. The two half-pieces of stick head can be combined to be a hollow stick head. A polygonal opening 31 is located in the center-left of the right half-piece for corresponding to the said polygonal opening 21.

Figure 3:
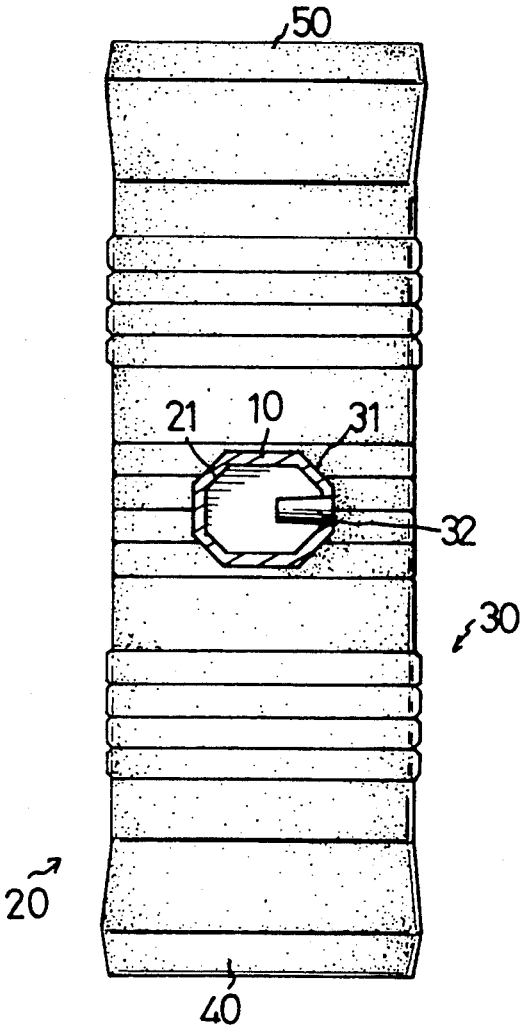
FIG. 3 is a sectional assembly view of an improved croquet of the present invention.

Referring to FIG. 3, therein illustrated is a pillaret 32 centered in the polygonal opening 31 so as to connect with the stick 10 by inserting the pillaret 32 into the opening 11, of the stick 10. The stick 10 is interlocated in the middle of the two corresponding polygonal openings 21, 31 so as to connect with the stick head together. There are arc slots 33, 34 on the surface in the front and rear of right half-piece corresponding to the said arc slots 22, 23. The stick 10 and the two half-pieces of stick head 20, 30 are connected with each other securely through supersonic waves treatment. The connecting cases 40 and 50 are secured on both ends of the stick head. Inside the connecting cases 40 and 50, there are many protuberant edages 51 corresponding and connecting to the said arc slots 22 and 23 of the left half-piece and arc slots 33 and 34 of the right half-piece.

Figure 4:
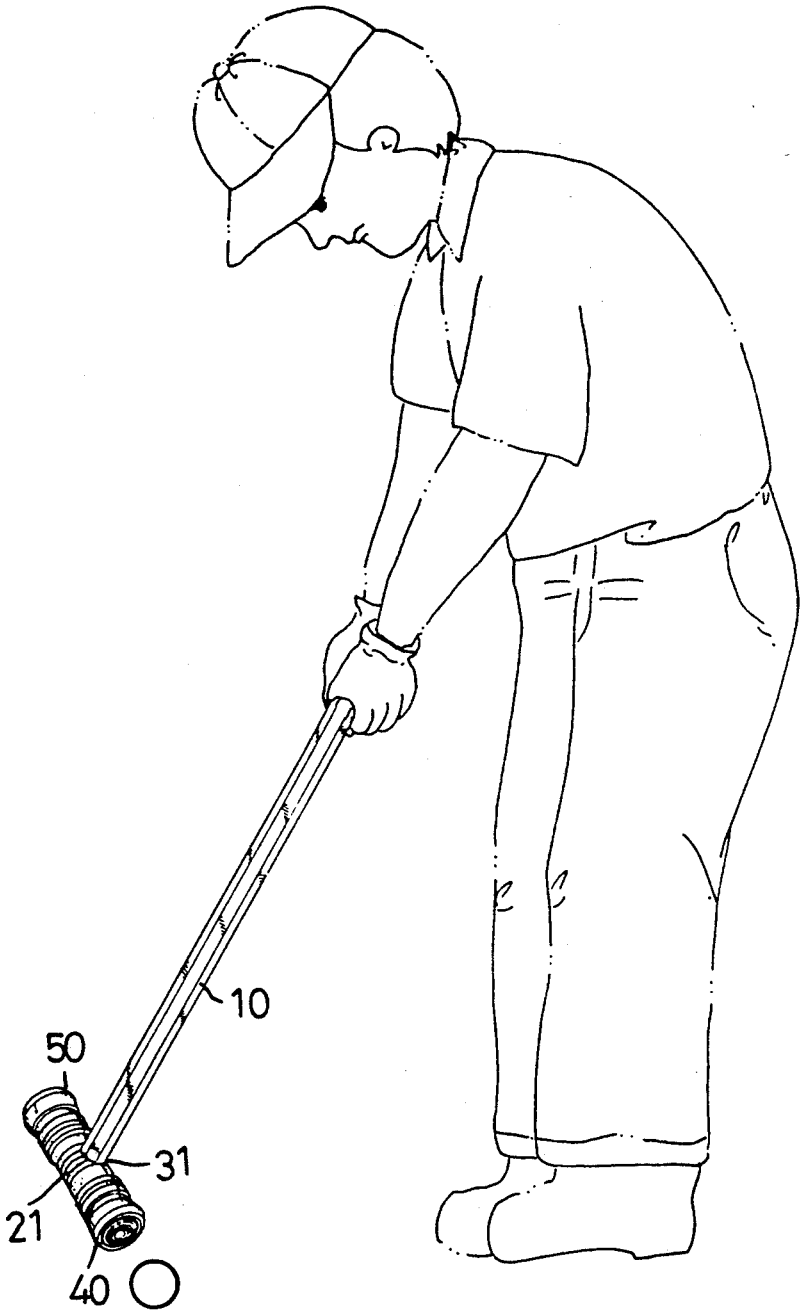
FIG. 4 is an illustation showing how to use the improved croquet stick of the present invention.
Figure 5:
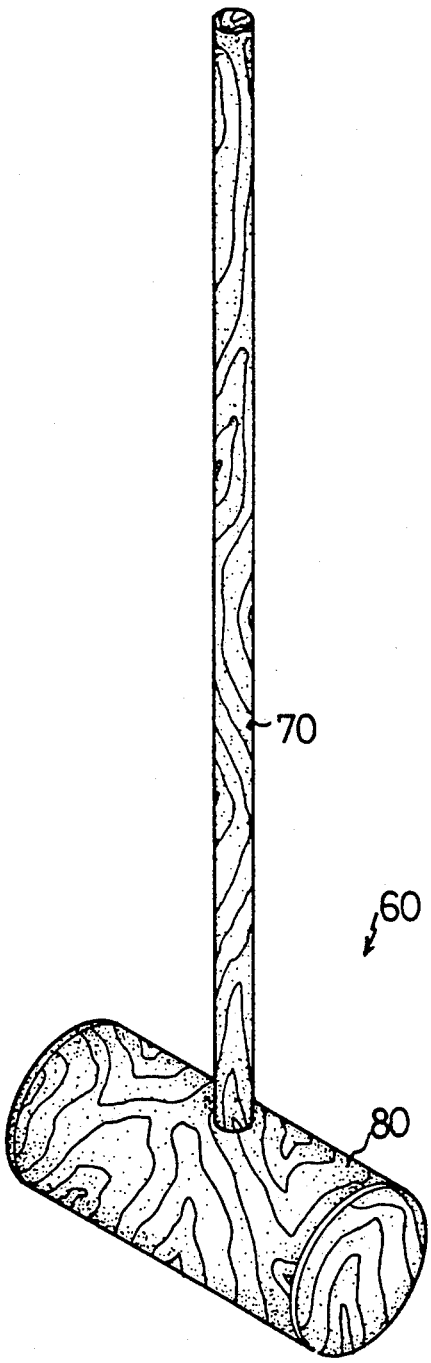
FIG. 5 is a three-dimensional external view of a croquet stick according to the prior art.

Referring to FIG. 4, therein illustrated is the use of the improved croquet stick of the present invention. The croquet player holds the stick 10 and strikes the ball with the connecting case 40 or 50.

Apart from the above description, we can still find out the following advantages of the improved croquet stick of the present invention: The parts of the improved croquet stick are made of plastic materils through injection molding. Therefore, the improved croquet stick of the present invention can be manufactured and mass-produced easily and cost-efficiently.

While only few embodiments of the present invention has been shown and described, it will be understood that various modifications and changes could be made without departing from the spirit and scope of the invention.

What is claimed is:

1. An improved croquet stick comprising:

a stick with an octagonal cross section and with an opening in a side near a lower end;

a head comprised of two half portions generally semicircular in cross section and two cases to cover ends thereof; wherein two corresponding polygonal recesses are located in inner surfaces of the two half portions to receive said stick, the stick being secured to the head by means of a pillaret which protrudes from one of the half sections of the head and is received by the opening in the stick, the two half sections of the head being bonded securely together to form a single element to strike a ball.

2. The improved croquet stick of claim 3 wherein:

the two half portions of the head are bonded by ultrasonic welding.

* * * * *